US012305962B1

(12) United States Patent
Asiyanbola et al.

(10) Patent No.: US 12,305,962 B1
(45) Date of Patent: May 20, 2025

(54) PROJECTILE SHIELD WITH ENHANCED PROJECTILE REBOUND/RICOCHET

(71) Applicant: Bolanle Asiyanbola, Hermitage, TN (US)

(72) Inventors: Bolanle Asiyanbola, Hermitage, TN (US); Michael Bubolz, Milwaukee, WI (US)

(73) Assignee: Bolanle Asiyanbola, Hermitage, TN (US)

( * ) Notice: Subject to any disclaimer, the term of this patent is extended or adjusted under 35 U.S.C. 154(b) by 95 days.

(21) Appl. No.: 18/213,325

(22) Filed: Jun. 23, 2023

Related U.S. Application Data

(60) Provisional application No. 63/355,499, filed on Jun. 24, 2022.

(51) Int. Cl.
*F41H 5/007* (2006.01)
*F41H 5/04* (2006.01)
*F41H 5/06* (2006.01)

(52) U.S. Cl.
CPC ..... *F41H 5/007* (2013.01); *F41H 5/0471* (2013.01); *F41H 5/06* (2013.01)

(58) Field of Classification Search
CPC ..... F41H 5/007; F41H 5/0471; F41H 5/06
USPC ..... 89/36.02
See application file for complete search history.

(56) References Cited

U.S. PATENT DOCUMENTS 2,723,214 A 11/1955 Meyer
3,640,831 A 2/1972 Gardner
4,404,889 A * 9/1983 Miguel ..... B32B 15/14 89/36.02
5,082,289 A 1/1992 Paranto
5,093,931 A 3/1992 LaBerge
5,349,893 A * 9/1994 Dunn ..... F41H 5/04 428/116
5,738,925 A 4/1998 Chaput
5,824,940 A 10/1998 Chediak
5,885,912 A 3/1999 Bumbarger
6,500,507 B1 12/2002 Fisher
6,997,218 B1 2/2006 Garcia
7,571,493 B1 8/2009 Purvis
7,770,233 B2 8/2010 Haskell
8,037,804 B1 10/2011 Wahlquist
8,201,488 B1 6/2012 Daniels
8,291,808 B2 10/2012 Howland
8,375,839 B2 * 2/2013 Landi ..... F41H 5/0471 89/36.02
8,863,634 B1 * 10/2014 Lou ..... F42D 5/05 89/36.02
8,904,915 B2 12/2014 Howland
10,591,257 B1 * 3/2020 Barr ..... B22F 10/28
10,866,067 B2 12/2020 Raber
(Continued)

*Primary Examiner* — Samir Abdosh

(74) *Attorney, Agent, or Firm* — Craig Fieschko; DeWitt LLP

(57) ABSTRACT

A ballistic shield has a front "bulletproof" ballistic fabric layer with an elastic layer situated behind, such that when a projectile strikes the ballistic fabric layer, the layers yield rearwardly, with the elastic layer then rebounding the projectile. The rebounded projectile thereby serves as a hazard (or at least a distraction) to the shooter. The elastic layer may be provided as one or more inflatable sublayers, allowing the ballistic shield to be rapidly inflated for use, and otherwise folded for storage and transport.

19 Claims, 4 Drawing Sheets

(56) References Cited

U.S. PATENT DOCUMENTS

| | | | | |
|---|---|---|---|---|
| 11,226,178 | B1 * | 1/2022 | Goepfert | F41H 5/007 |
| 11,353,294 | B2 * | 6/2022 | Hall | F41H 5/04 |
| 2006/0212985 | A1 | 9/2006 | Lolis | |
| 2007/0099526 | A1 | 5/2007 | Heerden | |
| 2008/0264244 | A1 | 10/2008 | Ravid | |
| 2009/0266226 | A1 | 10/2009 | Beach | |
| 2010/0186134 | A1 | 7/2010 | Hunter | |
| 2011/0192274 | A1 | 8/2011 | Fingerhut | |
| 2012/0137865 | A1 | 6/2012 | Citterio | |
| 2014/0359912 | A1 | 12/2014 | Sutton | |
| 2020/0018574 | A1 | 1/2020 | Nash | |
| 2021/0108894 | A1 | 4/2021 | Wang | |
| 2021/0270574 | A1 | 9/2021 | Bopp | |
| 2022/0167690 | A1 | 6/2022 | Blecher | |

* cited by examiner

PROJECTILE SHIELD WITH ENHANCED PROJECTILE REBOUND/RICOCHET

CROSS-REFERENCE TO RELATED APPLICATIONS

This application claims priority under 35 USC § 119 (e) to U.S. Provisional Patent Application 63/355,499 filed Jun. 24, 2022, the entirety of which is incorporated by reference herein.

FIELD OF THE INVENTION

This document concerns an invention relating generally to shields for protection from projectiles, and more specifically to shields which tend to rebound/ricochet incoming projectiles.

BACKGROUND OF THE INVENTION

Shootings at workplaces, schools, and other sites are of concern owing to increased instances of such shootings in recent years. Many sites have developed contingency plans for active shooters, typically calling for rapid evacuation and/or hiding in place until emergency personnel arrive. Hiding in place provides limited safety, as shooters may roam the area for targets and shoot any whom they may encounter. Protocols for hiding in place typically call for closing and barricading doors, or otherwise situating as many obstacles between the shooter and the target(s) as possible. However, these measures can signal to a shooter where potential targets may be present, and they merely offer a passive defense to projectiles (and a weak one at that, as doors and other commonly available obstacles are typically insufficient to stop projectiles, particularly from large-caliber and common semiautomatic weapons). Ideally, an obstacle should deter the shooter from firing at the obstacle as well as defending against projectiles.

SUMMARY OF THE INVENTION

The invention, which is defined by the claims set forth at the end of this document, is directed to a ballistic shield which may be rapidly deployed in doorways, windows, hallways, or elsewhere, and which rebounds incoming projectiles to deter further shooting. A basic understanding of some of the features of preferred versions of the invention can be attained from a review of the following brief summary of the invention, with more details being provided elsewhere in this document. To assist in the reader's understanding, the following review makes reference to the accompanying drawings of an exemplary version of the invention (these drawings being briefly reviewed in the "Brief Description of the Drawings" section following this Summary section of this document).

FIG. 2 depicts an exemplary ballistic shield 100 as it might appear when deployed, with FIG. 1 showing preferred components of the ballistic shield 100 and FIG. 3 showing the ballistic shield 100 as it might appear prior to deployment. Referring to FIG. 1, the ballistic shield 100 includes the following layers affixed in series: a front ballistic textile layer 102 configured to prevent passage of projectiles; an elastic layer 104 configured to elastically deflect when the ballistic textile layer 102 is struck by a projectile, and thereafter at least substantially return to its pre-strike location; and an optional damping layer 106 configured to absorb and/or divert some of the energy of the projectile.

The ballistic textile layer 102 is a flexible material, such as an aramid fabric (e.g., KEVLAR from DuPont de Nemours, Inc.), which is at least substantially "bulletproof." The elastic layer 104 is then preferably formed of arrayed cells 108 having flexible cell walls 110, and configured to contain a compressible fluid (e.g., air). Thus, when the cells 108 are empty, the ballistic shield 100 may be flattened (as in FIG. 3) and rolled or folded, and the cells 108 may thereafter be rapidly filled with compressible fluid to deploy the ballistic shield 100 (as in FIG. 2) for use as a protective barrier. When a projectile strikes the front ballistic textile layer 102, the ballistic textile layer 102 deflects rearwardly, elastically deforming the elastic layer 104, which then springs back and launches the projectile away from the ballistic shield 100 (often along an outgoing trajectory which is the same as, or close to, the projectile's incoming trajectory). The rebounded projectile thereby poses a significant distraction (if not a hazard) for the shooter, deterring further firing.

Preferably, the elastic layer 104 includes two or more adjoining cellular sublayers 112 wherein each sublayer 112 includes arrayed cells 108. In at least the cellular sublayer 112 closest to the ballistic textile layer 102, the cells 108 are most preferably arrayed in adjoining fashion such that the cells 108 continuously extend across the surface of the cellular sublayer 112 facing the ballistic textile layer 102. Tessellated cells 108, such as the hexagonal arrays of FIGS. 1-3, can beneficially provide more uniform elasticity across the area of a cellular sublayer 112 when filled with compressible fluid, particularly when the cells 108 of the different sublayers 112 are offset from each other. The cells 108 of the cellular sublayer 112 closest to the ballistic textile layer 102 are preferably filled with compressible fluid to a lower pressure than the compressible fluid of the cells 108 of the cellular sublayer 112 furthest from the ballistic textile layer 102, allowing the ballistic textile layer 102 to more readily displace rearwardly under projectile impact.

The optional damping layer 106 can be affixed between the ballistic textile layer 102 and the elastic layer 104 if there is a desire to decrease the energy (speed) of the rebounding projectile. The depicted damping layer 106 is shown as a tessellated array of cells 114 filled with dilatant (shear-thickening fluid), whereby rapid deflection of a cell 114 (as from the impact of a projectile on the adjacent ballistic textile layer 102) causes the dilatant therein to thicken/harden. As depicted in FIGS. 1-3, the cells 108 of the elastic layer 104 (more particularly, of each cellular sublayer 112) may be connected in fluid communication with a filling means 116 for filling the cells 108 with compressible fluid, with the filling means 116 here being depicted as a canister of compressed air. Each cellular sublayer 112 receives the air from the filling means 116 via respective supply lines 118, here being shown with pressure control valves 120 limiting the pressure of the compressible fluid within each cellular sublayer 112 to a desired level. The cells 108 within each sublayer 112 each have one or more passages opening onto one or more adjacent cells 108, whereby compressible fluid supplied to one cell may be communicated to all cells 108. A remotely-controllable deployment valve 122 may be provided to initiate fluid supply from the filling means 116 to the elastic layer 104, allowing personnel to rapidly deploy the ballistic shield 100 in the event of danger.

An exemplary installation for the ballistic shield 100 of FIGS. 1-3 is depicted in FIGS. 4-5. In FIG. 4, the ballistic shield 100 (with empty cells 108, as in FIG. 3) is folded within a container 124 situated above a portal 126 such as a doorway. When the filling means 116 is actuated to fill the elastic layer 104 with compressible fluid, the elastic layer 104 inflates, unfolding the ballistic shield 100 to force open the floor 128 of the container 124 such that the ballistic shield 100 projects from the container 124 to obstruct the portal 126 (as seen in FIG. 5).

Further potential advantages, features, and objectives of the invention will be apparent from the remainder of this document in conjunction with the associated drawings.

DETAILED DESCRIPTION OF EXEMPLARY VERSIONS OF THE INVENTION

Figure 1:
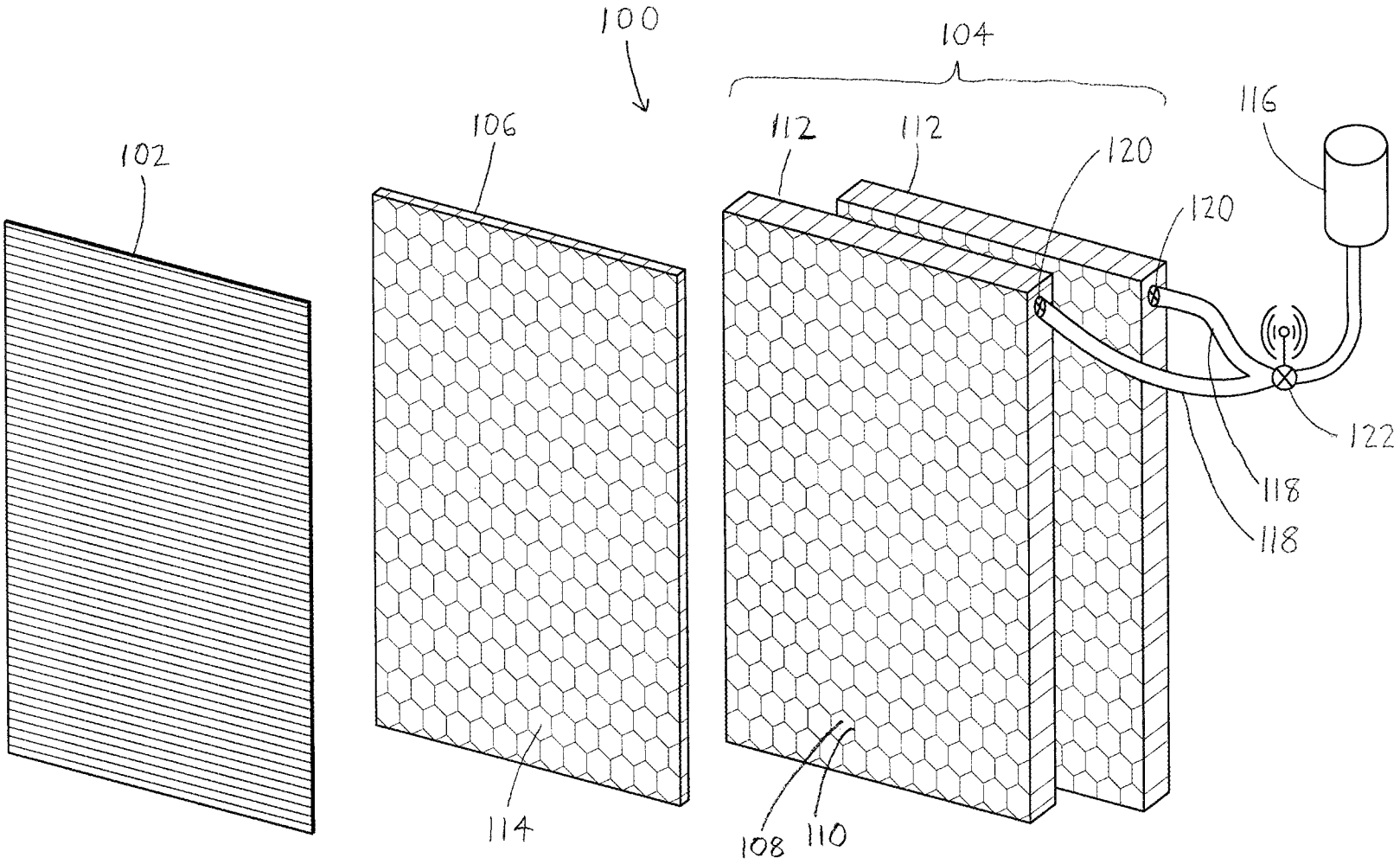
FIG. 1 is an exploded (disassembled) isometric view of an exemplary ballistic shield 100, depicting its outer ballistic textile layer 102, its (optional) damping layer 106, and its elastic layer 104 (depicted with two cellular sublayers 112), with the elastic layer 104 being supplied with compressible fluid from filling means 116 via supply lines 118.
Figure 2:
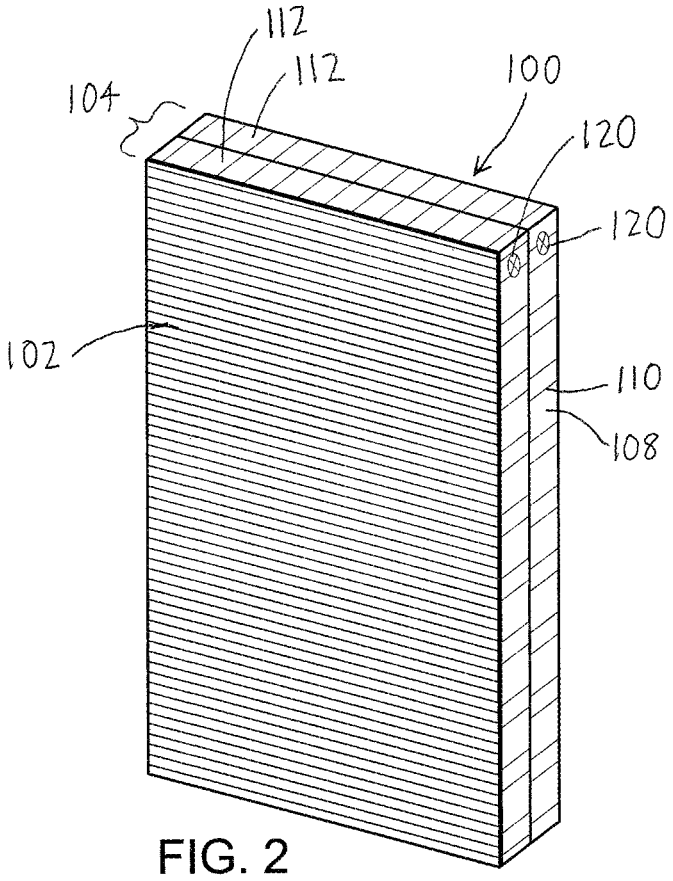
FIG. 2 is an assembled isometric view of the ballistic shield 100 of FIG. 1, shown without the damping layer 106, supply lines 118, and filling means 116 of FIG. 1.
Figure 3:
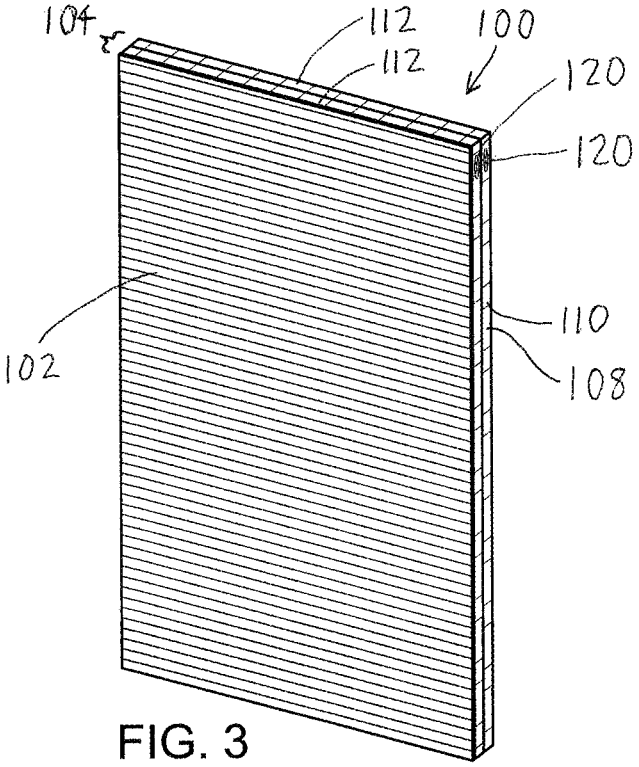
FIG. 3 is an isometric view of the ballistic shield 100 of FIG. 2 shown with its elastic layer 104 deflated, such that the ballistic shield 100 may be rolled, folded, bunched, or otherwise compacted for later inflation/deployment.

The outer ballistic textile layer 102 is intended to halt the passage of projectiles, and is formed of ballistic textile, a flexible textile resistant to breakage/penetration from high-velocity flying objects such as projectiles and shrapnel. Ballistic textiles are typically formed of fibers or yarns of ballistic material arrayed into a sheet-like form (whether as a layer of fibers/yarns aligned in parallel; as multiple such layers with each layer's fibers/yarns oriented at an angle to the fibers/yarns of one or more adjacent layers; as a woven or knitted array; or otherwise). A "ballistic material" can be regarded as any material having antiballistic properties equal to or greater than nylon, with exemplary preferred ballistic materials being aramid (e.g., KEVLAR) and UHMWPE (Ultra High Molecular Weight Polyethylene) (e.g., DYNEEMA from Avient Corporation). A preferred ballistic textile is GOLDFLEX (from Honeywell International, Inc.), a nonwoven aramid fabric. The ballistic textile layer 102 may be formed of one or more sublayers of ballistic textile, with the sublayers being sewn, adhered, or otherwise joined. Use of a single (or few) sublayer(s) of ballistic textiles is preferred, as fewer sublayers better maintain the elasticity of the ballistic shield 100. Greater numbers of sublayers may be used where the ballistic textiles have higher elasticity, as where fibers/yarns of ballistic material are held within a matrix of elastic/fibers/yarns). Use of fewer sublayers may allow a projectile to at least partially penetrate the ballistic textile layer 102, but the projectile will typically not penetrate the underlying elastic layer 104 (here assuming a projectile having the speed, mass, and/or surface area/configuration conventionally encountered with civilian firearms).

The optional damping layer 106 may be incorporated in the ballistic shield 100 if it is desired to reduce the energy (speed) of projectiles rebounded from the ballistic shield 100. Experimental versions of the ballistic shield 100 have resulted in projectiles rebounding from the ballistic shield 100 at as much as approximately 70% of their incoming velocity, which is sufficient to incapacitate a shooter in the rebounded projectile's path. Such a high-energy rebound is useful in hide-in-place scenarios, where the shooter may be the only person vulnerable to a rebounded projectile (as the potential targets will be behind the ballistic shield 100, or will otherwise be sheltered). However, in some situations—e.g., when shooting begins within a crowd, and the ballistic shield 100 is deployed in response—it may be desirable to slow the rebounded projectiles such that they are no longer potentially harmful to bystanders.

The depicted damping layer 106 is formed of a pair of flexible polymer sheets (e.g., polyvinyl chloride, neoprene, thermoplastic polyurethane, or nylon sheet/fabric) joined face-to-face to provide a tessellated array of cells 114 therebetween. These cells 114 contain dilatant, that is, a non-Newtonian shear-thickening fluid whose viscosity increases as it experiences greater shear. Thus, when the ballistic textile layer 102 is struck by a projectile and the impact forces are transmitted to the adjacent cell 114 of the damping layer 106, the dilatant therein becomes thicker, and the impact forces are better transmitted over the entire area of the cell 114 onto the adjacent elastic layer 104. While any dilatant may be used, it is preferably one which exhibits a high increase in viscosity as shear rate increases. A common dilatant suitable for use in the invention is PEG-400 (i.e., polyethylene glycol). A dilatant-containing damping layer 106 need not be cellular, though the cells 114 are useful to prevent dilatant from draining from the top of the damping layer 106 to collect at the bottom of the damping layer 106.

The damping layer 106 could take forms other than those depicted, and could be formed of any matter which absorbs or redirects energy, and which is sufficiently flexible that the ballistic shield 100 may convert between undeployed/collapsed and deployed/inflated states. As an example, the damping layer 106 could be formed of an array of soft or frangible metal, plastic, or ceramic plates affixed to the rear face of the ballistic textile layer 102, with the plates preferably being spaced such that a projectile cannot fit between adjacent plates, but such that the ballistic textile layer 102 at least substantially retains its flexibility. Breakage or deformation of such plates will absorb impact energy, thereby reducing the potential energy captured by flexure of the ballistic shield 100 (and thus reducing the kinetic energy of the projectile resulting from the release of such potential energy).

The elastic layer 104 may take any form that allows the ballistic shield 100 to at least substantially return to its pre-strike shape after being struck by a projectile. Stated differently, after a projectile strikes (but does not penetrate) the ballistic textile layer 102, the face of the elastic layer 104 closest the ballistic textile layer 102, at a location situated along a vector defining the path of the projectile, deviates from its pre-strike location by no more than 5% of the thickness of the elastic layer 104. As an example, the elastic layer 104 could simply take the form of one or more (sub) layers of elastane, neoprene, or other highly elastic textiles or sheets. The preferred form of the elastic layer 104 has opposing faces which are elastically biased apart. In the depicted elastic layer 104, two structures of this nature are provided as sublayers 112, with each sublayer 112 being configured of elastic material (e.g., polyvinyl chloride, neoprene, thermoplastic polyurethane, or nylon sheet/fabric) formed to contain a compressible fluid, somewhat like an inflatable mattress. Each sublayer 112 has cells 108 formed therein, with passages between the cells 108 (such passages not being depicted in the drawings) allowing all cells 108 to be inflated from a filling point (here valves 120). These passages between cells 108 are preferably provided with valves which limit deflation of all cells 108 in the event one cell is punctured. Such valves could take any suitable form, e.g., the form of check valves used for inflation of inflatable balls (e.g., basketballs). A particularly preferred valve for use between cells 108 is a flap check valve, also known as a flap gate. In such a valve, a fluid-receiving cell includes a flap on its cell wall which covers the aperture leading to the fluid-supplying cell, such that fluid may flow through the aperture from the fluid-supplying cell (the flap yielding during such flow), whereas counterflow from the fluid-receiving cell to the fluid-supplying cell presses the flap against the aperture to close it (halting the counterflow).

The cells 108 are preferably arrayed such that they extend across the entire surface of the elastic layer 104 facing the ballistic textile layer 102, such that the entirety of this surface provides an elastic response when struck. While the cells 108 can have any suitable shape and size (and might be provided in a variety of cell shapes and/or sizes), the cells 108 are preferably similarly configured so that all cells 108 have approximately the same elastic response. In the depicted cellular sublayers 112 of the elastic layer 104, the cells 108 are provided with hexagonal shapes which are tessellated across the planes of the sublayers 112. Alternative tessellated cell shapes might be used, e.g., square or triangular cells 108.

Where the elastic layer 104 is formed of two or more cellular sublayers 112, the cells 108 of each cellular sublayer 112 are preferably offset from the cells 108 of the adjacent cellular sublayer 112 (*s*), that is, the centerpoints and borders of the cells 108 in one sublayer 112 are (at least in major part) not aligned with the centerpoints and borders of the cells 108 in the adjacent sublayer 112 (*s*). Such an arrangement promotes a more uniform elastic response across the elastic layer 104. Additionally, it is preferred that the sublayer 112 situated closest to the ballistic textile layer 102 be at a lower pressure than the succeeding sublayer 112 (and that any successive sublayers 112 have increasing pressures), allowing the ballistic textile layer 102 to better elastically deflect when struck by a projectile.

The various layers 102, 104/112, and 106 may be affixed together by sewing, adhesive, thermal bonding, or any other suitable joinder methods. Additional layers may be incorporated on or within the ballistic shield 100 so long as they do not interfere with the aforementioned objectives of the ballistic shield 100. As an example, an additional ballistic textile layer 102 could be provided behind the clastic layer 104, or between any sublayers 112 in the elastic layer 104, as a safeguard against projectile penetration.

The filling means 116 for filling the cells 108 with fluid is preferably provided in the form of a container filled with compressed gas, such as air, nitrogen, or carbon dioxide. The filling means 116 could instead be provided by an air compressor, or even simply by the atmosphere if the cell walls 110 are formed with sufficient resilience that the ballistic shield 100, when relieved of a compressing force, springs from a flattened or folded state into a deployed state, with the expansion of the previously-collapsed cells 108 pulling in atmospheric air. The filling means 116 supplies the cellular sublayers 112 with compressible fluid through respective supply lines 118, each leading to respective valves 120 on the sublayers 112 which are suitable to fill the cells 108 of each sublayer 112 to the desired pressure, e.g., via limit valves having the desired shutoff pressures. A deployment valve 122 is also provided to activate supply of the compressible fluid from the filling means 116 to the elastic layer 104, with the deployment valve 122 preferably being an on-off valve which can be rapidly switched between fully open and fully closed states. A preferred arrangement is to use a remotely-controllable valve, i.e., a valve that can be electronically actuated from a closed state to an open state from a distance of ten or more feet from the valve. This allows the ballistic shield 100 to be rapidly deployed via a wired or wireless signal from a central office (which might monitor the vicinity of the ballistic shield 100 via video), via a "panic button" at a desk nearby the ballistic shield 100, or via a wireless remote control carried by selected personnel. The deployment valve 122 could also or alternatively be deployed automatically, as by gunfire/threat detection technologies. Technologies of this nature are available from, e.g., Shotspotter, Inc. of Newark, California; Shooter Detection Systems, LLC of Newburyport, Massachusetts; and Zeroeyes LLC of Philadelphia, Pennsylvania.

Figure 4:
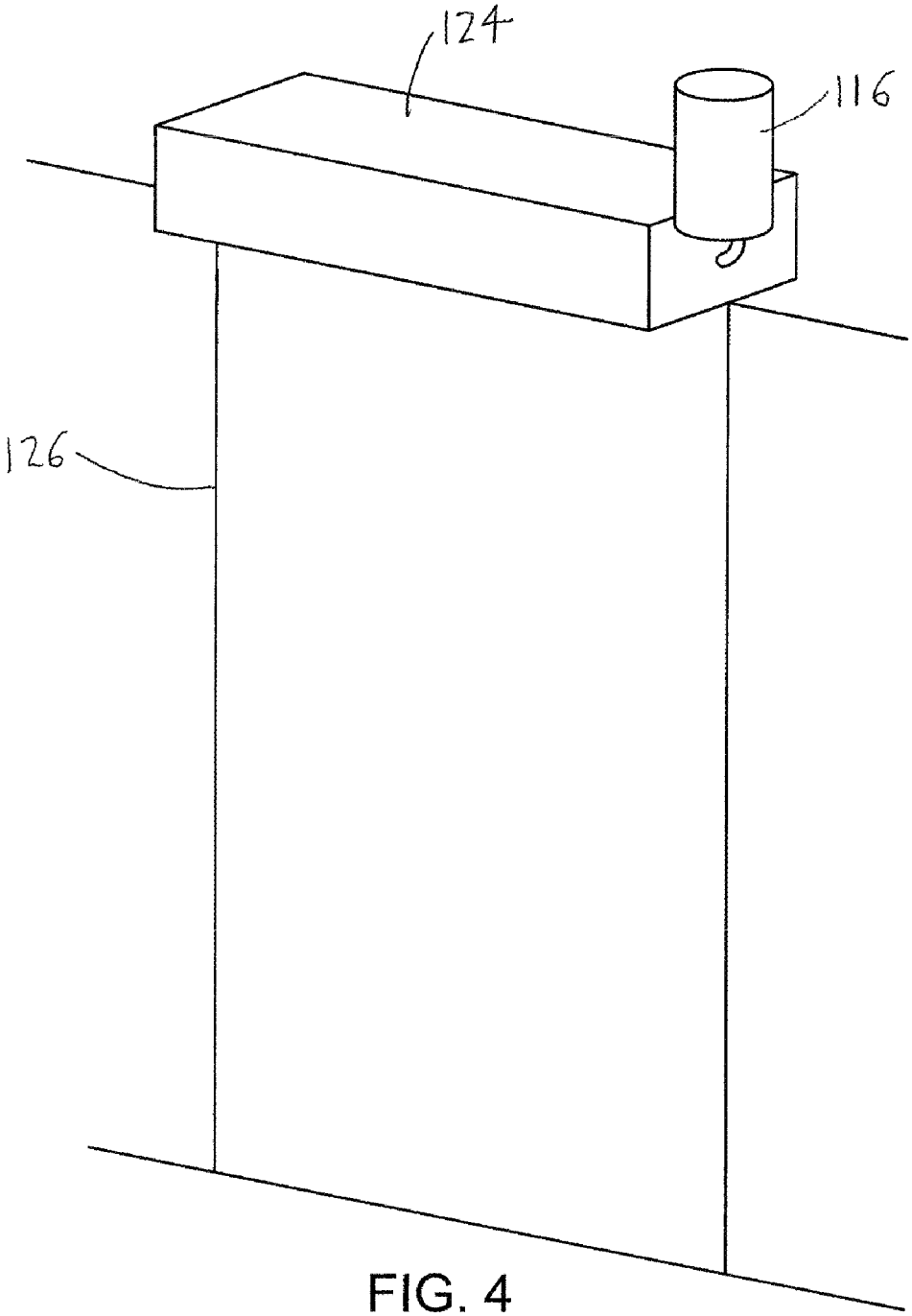
FIG. 4 depicts an exemplary use for the ballistic shield 100 of FIGS. 1-3, wherein the ballistic shield 100 is provided in undeployed (deflated) form within a container 124 situated above a doorway 126.
Figure 5:
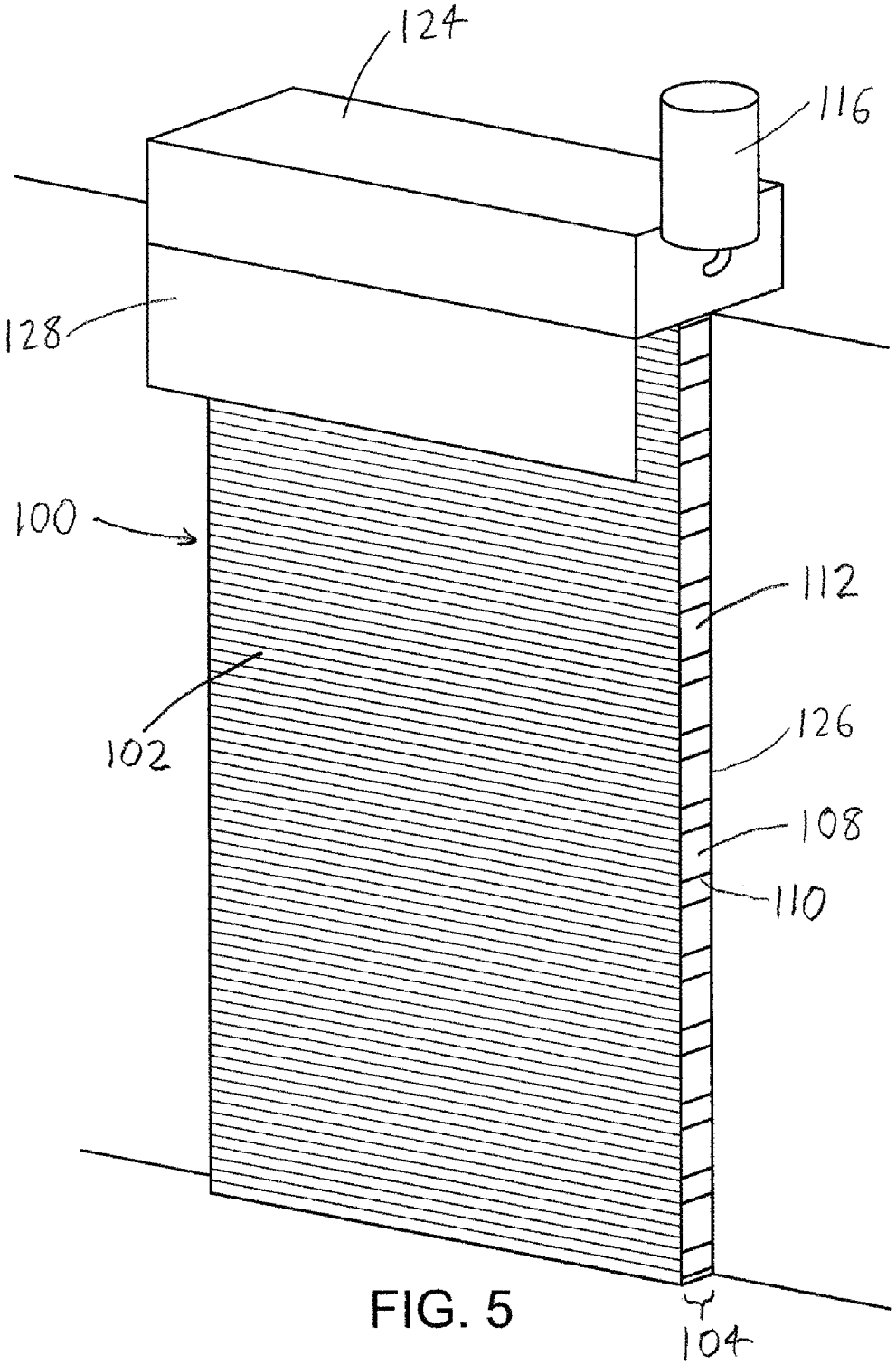
FIG. 5 depicts the arrangement of FIG. 4 after the filling means 116 deploys (inflates) the elastic layer 104 of the ballistic shield 100, with the ballistic shield 100 then pushing from the container 124 to fill the doorway 126.

The ballistic shield 100 may then be situated for deployment in or adjacent to a portal 126 (i.e., any passage usable for ingress or egress, e.g., a doorway or window), in a hallway, or at any other area where the ballistic shield 100 might usefully be deployed as a protective curtain. FIG. 4 depicts an exemplary ballistic shield 100 placement wherein the undeployed/deflated ballistic shield 100 is folded to fit within a container 124 above a doorway 126. ("Folded" encompasses both orderly folding as well as rolling, bunching or wadding of the ballistic shield 100.) Upon actuation of the deployment valve, the ballistic shield 100 deploys/inflates, with the container floor 128 yielding to allow the ballistic shield 100 to expand to fill the doorway 126 as in FIG. 5. Such a container floor 128 may be hinged to the container 124, and latched when closed such that it supports the folded ballistic shield 100, with the latch then being defeated under the force of the inflating ballistic shield 100. The ballistic shield 100 need not be deployed from overhead as in FIGS. 4-5, and could be deployed from floors, walls, or other locations (whether from a container 124 or otherwise) to provide safety when a shooter may be present. The ballistic shield 100 could also be configured for portable deployment, e.g., at political rallies, protests/demonstrations, sporting events, or other events, as by providing a ballasted base atop which the ballistic shield 100 is folded. Upon detection of actual or potential gunfire, the deployment valve 122 can be actuated to inflate the ballistic shield 100 such that it stands upright from the base. Multiple units of this nature can be situated such that the ballistic shields 100, when deployed, effectively form a wall.

The ballistic shield 100 may have components in addition to those described above, and/or may be configured differently from the exemplary version depicted in the accompanying drawings. As an example, the ballistic shield 100 might be provided in a curved or angled form rather than in the planar version depicted, for instance, by configuring the ballistic shield 100 as walls which encircle a shielded space wherein personnel might shelter.

The versions of the invention described above are merely exemplary, and the invention is not intended to be limited to these versions. Rather, the scope of rights to the invention is limited only by the claims set out below, and the invention encompasses all different versions that fall literally or equivalently within the scope of these claims. In these claims, no element therein should be interpreted as a "means-plus-function" element or a "step-plus-function" element pursuant to 35 U.S.C. § 112 (f) unless the words "means for" or "step for" are explicitly used in the particular element in question.

The invention claimed is:

1. A ballistic shield including:

a. a ballistic textile layer, b. an elastic layer:

(1) affixed to the ballistic textile layer, (2) configured to reversibly convert between:

(a) an inflated state wherein the elastic layer contains a compressible fluid therein, whereby the ballistic shield:

i. elastically deflects when the ballistic textile layer is struck by a projectile, and ii. thereafter at least substantially returns to its pre-strike shape, and (b) a collapsed state wherein the elastic layer:

i. contains lesser fluid than, and ii. has lesser volume than, when in the inflated state.

2. The ballistic shield of claim 1 wherein the elastic layer includes arrayed cells:

a. having flexible cell walls, b. being configured to contain a compressible fluid, and c. in fluid communication with each other.

3. The ballistic shield of claim 2 wherein the elastic layer includes two or more adjoining cellular sublayers, each sublayer having the arrayed cells therein.

4. The ballistic shield of claim 3 wherein the arrayed cells within each sublayer are adjoined.

5. The ballistic shield of claim 4 wherein the arrayed cells within each sublayer are tessellated.

6. The ballistic shield of claim 3 wherein:

a. the cells of the cellular sublayers contain a compressible fluid, and b. the compressible fluid of the cells of the cellular sublayer closest to the ballistic textile layer is at a lower pressure than the compressible fluid of the cells of the cellular sublayer furthest from the ballistic textile layer.

7. The ballistic shield of claim 2 wherein the cells of each cellular sublayer are offset from the cells of each adjoining cellular sublayer.

8. The ballistic shield of claim 2 wherein the cells within each cellular sublayer are in fluid communication with a filling means for filling the cells with fluid.

9. The ballistic shield of claim 2 wherein the cells are:

selectively connected to a source of compressed fluid via a remotely-controllable valve.

10. The ballistic shield of claim 2 wherein:

a. the cells are at least partially filled with a compressible fluid, and b. the ballistic shield is situated to obstruct at least a major portion of a portal.

11. The ballistic shield of claim 2 folded adjacent the border of a portal, whereby filling the cells with a compressible fluid unfolds the ballistic shield to at least partially block the portal.

12. The ballistic shield of claim 2 folded within a container having an opening defined therein, whereby filling the cells with a compressible fluid unfolds the ballistic shield to extend from the opening.

13. The ballistic shield of claim 1 further including a damping layer between the ballistic textile layer and the elastic layer, the damping layer including one or more cells containing dilatant.

14. A ballistic shield including:

a. a ballistic textile layer, b. an elastic layer:

(1) affixed to the ballistic textile layer, and (2) including two or more cellular sublayers, each cellular sublayer including arrayed cells wherein each cell:

(a) has elastic cell walls, (b) is at least partially filled with compressible fluid.

15. The ballistic shield of claim 14 wherein the compressible fluid of the cells of the cellular sublayer closest to the ballistic textile layer is at a lower pressure than the compressible fluid of the cells of the cellular sublayer furthest from the ballistic textile layer.

16. The ballistic shield of claim 14 wherein the cells of each cellular sublayer are offset from the cells of each adjoining cellular sublayer.

17. The ballistic shield of claim 14 situated within a portal.

18. A ballistic shield including:

a. a ballistic textile layer, b. an elastic layer affixed to the ballistic textile layer, the elastic layer including two or more adjoining cellular sublayers of tessellated cells:

(1) having flexible cell walls, and (2) being in fluid communication with a compressible fluid source.

19. The ballistic shield of claim 18 wherein the cells of each cellular sublayer are offset from the cells of each adjoining cellular sublayer.

* * * * *